US005279427A

United States Patent [19]

Mobley

[11] Patent Number: 5,279,427

[45] Date of Patent: Jan. 18, 1994

[54] ROTARY FEED TABLE FOR FOOD PRODUCT AND SLIVER REMOVER

[76] Inventor: John E. Mobley, 20571 Empire Ave., Bend, Oreg. 97701

[21] Appl. No.: 790,381

[22] Filed: Nov. 7, 1991

[51] Int. Cl.[5] ..... B07B 13/075

[52] U.S. Cl. ..... 209/668; 209/672; 209/673; 198/780

[58] Field of Search ..... 209/667, 668, 671, 672, 209/673, 618; 198/780; 193/37

[56] References Cited

U.S. PATENT DOCUMENTS 4,240,902 12/1980 Agee et al. ..... 209/671 X
4,790,439 12/1988 McIntyre et al. ..... 209/667

FOREIGN PATENT DOCUMENTS 535103 1/1957 Canada ..... 209/667
633855 1/1962 Canada ..... 209/667
97418 of 1898 Fed. Rep. of Germany ..... 209/667
8601580 3/1986 World Int. Prop. O. ..... 209/667
980656 12/1982 U.S.S.R. ..... 209/673
197805 10/1975 United Kingdom ..... 209/672

*Primary Examiner*—David H. Bollinger
*Attorney, Agent, or Firm*—Chernoff, Vilhauer, McClung & Stenzel

[57] ABSTRACT

A roller bed for separating fines and slivers from sliced food product such as french fries includes a plurality of rollers placed side-by-side on parallel roller shafts and are shaped to provide alternating crown and flat portions about the periphery of each of the rollers. A motor coupled to the roller shafts rotates the rollers which are phased so that in the gaps between adjacent rollers the crown portions of one roller coincide with the flat portions of adjacent rollers. This arrangement moves properly sized product across the roller bed while allowing smaller fines and slivers to fall between the rollers.

15 Claims, 3 Drawing Sheets

ROTARY FEED TABLE FOR FOOD PRODUCT AND SLIVER REMOVER

BACKGROUND OF THE INVENTION

The following invention relates to a rotary feed table for separating slivers and fines from properly dimensioned food product.

Many food products such as french fried potatoes are sliced from raw potatoes to specific dimensions as required in certain applications. For example, the french fried potato product used in fast food restaurants must usually be sliced to meet a standard of one-quarter inch square in cross section.

Potatoes are irregularly shaped and the slicing process, while producing a large number of potato slices meeting specifications, also produces slivers and fines as a result of slicing near the rounded edges of the potatoes. Heretofore it has been very difficult to remove slivers and fines from the potato slices otherwise meeting specifications. Various machines have been employed for this purpose which have not accomplished the desired objective. A type of a french fry sliver removal machine marketed under the trademark SHUFFLO TM manufactured by Magnuson Corporation of Reno, Nev. is an example of one approach to french fry removal. The SHUFFLO TM remover consists of a horizontal bed of slats in which the individual slats are oriented at an angle to the horizontal. The slats move back and forth in the horizontal plane creating an action that shuffles the french fries from one end of the bed to the other. Because there are spaces between the slats, fines and slivers are expected to fall through the bed while a product having the correct dimensions will not. There are, however, several problems with the SHUFFLO TM remover. The first is that the slats can become easily bent which will either mash the product or allow product cut to specifications to slip through. The second is that this particular remover requires an abundance of water to keep the product wet which in turn requires extra equipment such as pumps and sprayers resulting in increased energy cost and expense.

Other methods of separating fines and slivers from sliced food product include the use of vibratory feed trays, screens and the like, none of which has proved to be satisfactory since they either fail to remove the slivers and fines or waste excessive product in doing so.

SUMMARY OF THE INVENTION

The present invention provides an apparatus for removing fines and slivers from sliced food product accurately and efficiently without wasting the food product in the process. According to the invention the apparatus comprises a horizontal bed of rollers arranged side-by-side and having essentially parallel roller shafts. Each roller has a peripheral surface which consists of alternately shaped crown and flat portions. There is a uniform gap spacing between adjacent rollers and the rollers are rotationally oriented with respect to one another such that in the gap between adjacent rollers, the crown portion of a first roller coincides with the flat portion of a second roller. The gap spacing between adjacent rollers may be adjusted to provide different spacings for different dimensions of food product. Also, the speed of the rollers may be varied depending upon whether fines or slivers are to be separated and depending on the nature of the food product itself.

The rollers, which all rotate in the same direction, either clockwise or counterclockwise, may be driven by any conventional means. The preferable method of driving the rollers is with a motor having an output shaft with a sprocket linked by a chain to a sprocket at the end of one of the roller shafts. This shaft has a second sprocket which is linked by a chain to sprockets on the ends of all of the other roller shafts. In this way the phasing of alternate crowns and flats between adjacent rollers in the gaps is maintained, providing the essential timing of rotatingbetween adjacent rollers.

Food product is deposited at one end of the horizontal bed of rollers and the rotational action of the rollers moves the product along the bed. Because of the speed of rotation, the phasing of the rollers and the gap spacing between adjacent rollers, fines and slivers fall through the roller bed while properly proportioned pieces of product are prevented from falling through and are carried by the rollers to the opposite end. This is accomplished without mashing, wasting or mangling properly proportioned product pieces Fines and slivers are treated differently from each other and one or more passes of the product across the roller bed with different roller speeds and gap spacings may be necessary in order to remove undesirable pieces of varying dimensions.

It is a principal object of this invention to provide a separating apparatus for a sliced food product which separates fines and slivers from properly dimensioned food product pieces efficiently and without damage to the product.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
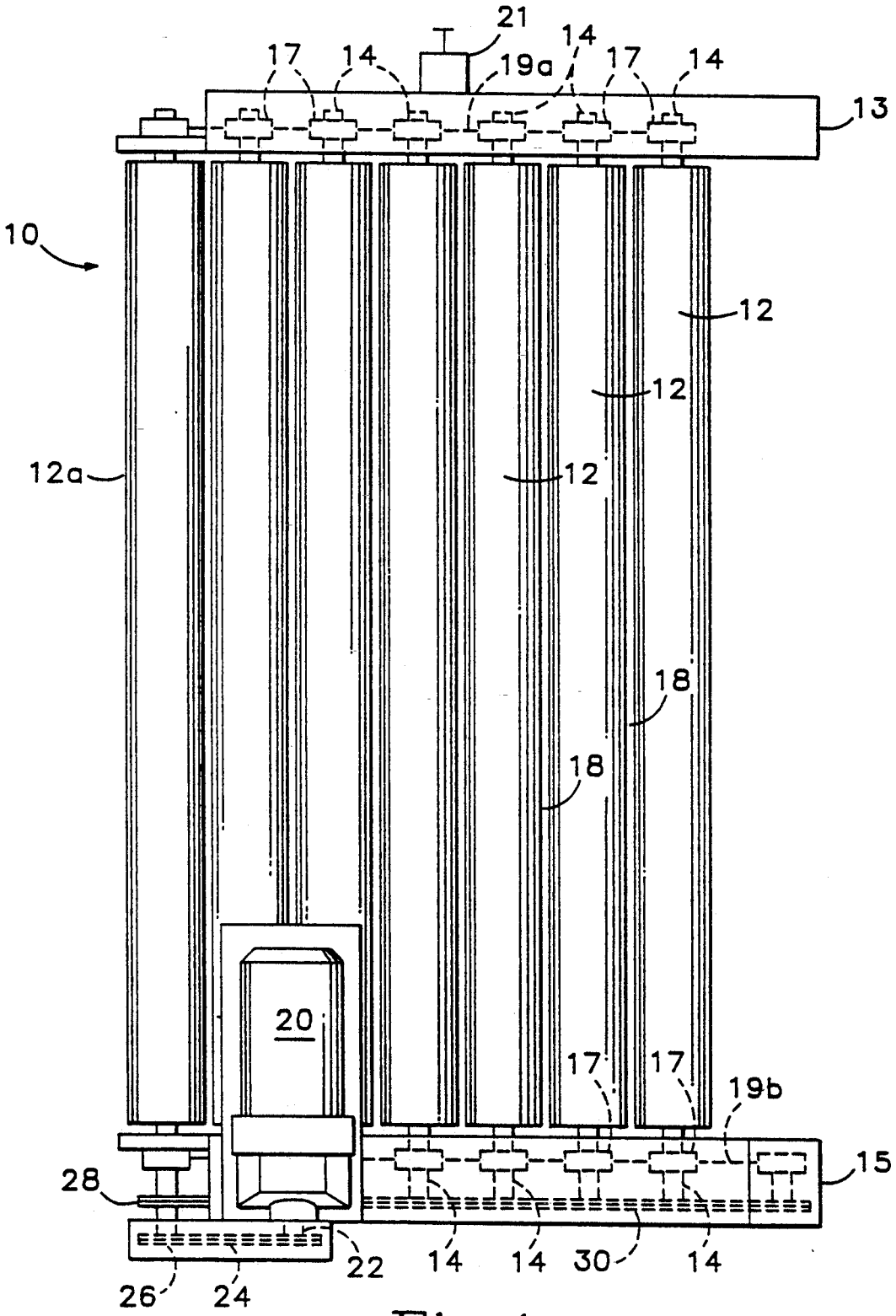
FIG. 1 is a top view of a roller table employing the present invention.
Figure 2:
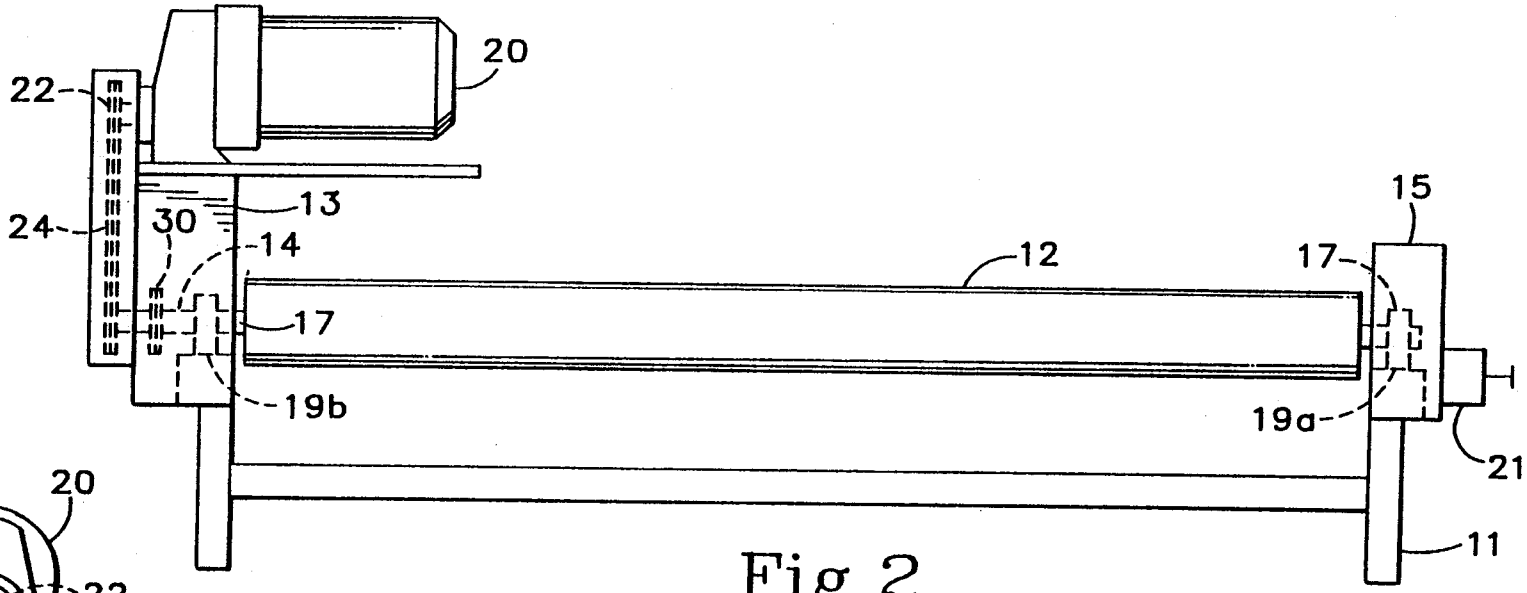
FIG. 2 is an end view of the roller table of FIG. 1.
Figure 3:
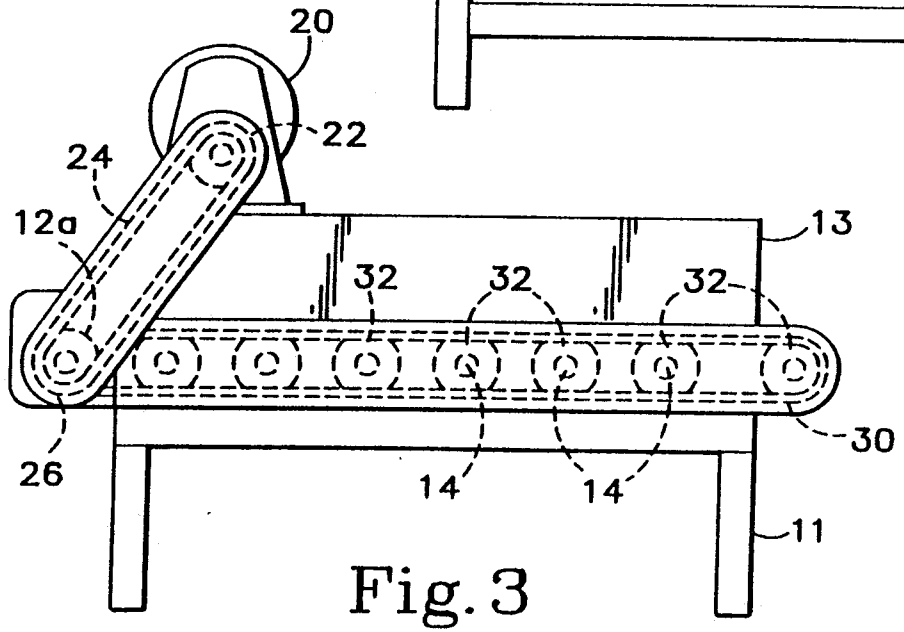
FIG. 3 is a side elevation view of the roller table of FIG. 1.

Referring to FIGS. 1, 2 and 3, a roller table 10 comprises a plurality of rollers 12 arranged in side-by-side relation on roller shafts 14 oriented essentially parallel to each other.

The rollers 12 are held at opposite ends of a frame 11 which includes housings 13 and 15. The housings 13 and 15 include yokes 17 or the like for receiving the ends of the roller shafts 14, and also include suitable bearings (not shown) for permitting rotation of the roller shafts 14. Additionally the yokes 17 are movable along tracks 19*a* and 19*b* by means of an adjustment control 21. Any suitable mechanical linkage linking the control 21 with the yokes 17 may be used for this purpose. This adjustment controls the width of the gaps 18 which in turn determines the size of the fines and slivers that will be allowed to pass through the rollers 12 into a receptacle (not shown) located below the roller bed 10.

The rollers 12 are caused to rotate by a motor 20 which includes an output shaft and sprocket 22 coupled to a chain 24. The chain 24 is in turn coupled to a sprocket 26 at the end of a roller 12*a* which functions as a drive roller. The drive roller 12*a* includes a second sprocket 28. A drive chain 30 is draped over the sprocket 28 and over similar sprockets 32 on the other roller shafts 14. In this way all of the rollers 12 are driven in the same direction and therefore move food product progressively across the roller table 10 in the direction of rotation.

Figure 4:
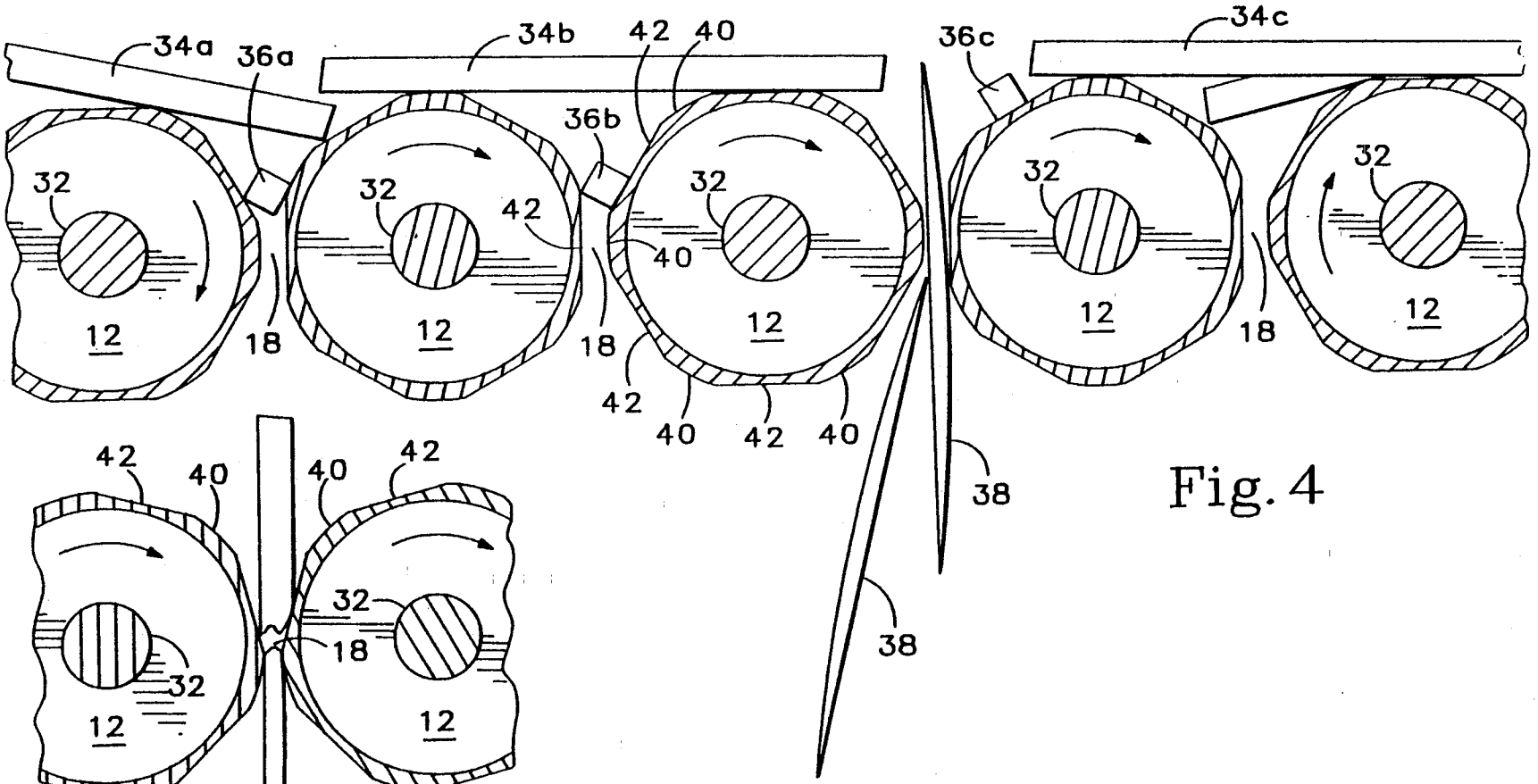
FIG. 4 is a partial cutaway side view of the rollers in the roller table of FIG. 3 as shown in actual use with food products.
Figure 4A:
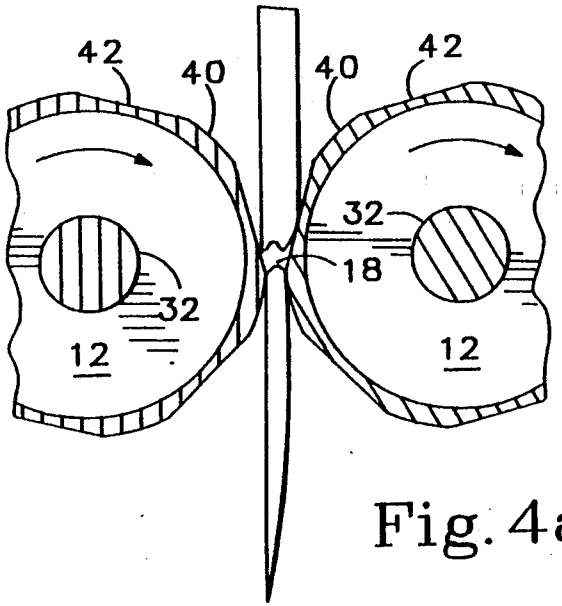
FIG. 4*a* is a partial side cutaway view similar to FIG. 4 showing the effect of the invention on food product having a partial sliver and a partial properly dimensioned piece.

The way in which the fines and slivers are separated from the properly proportioned sliced food product is shown in FIGS. 4 and 4*a*. The particular example given illustrates how the apparatus operates with potatoes, namely french fries, having a quarter inch square cross section. Wet french fries are deposited at one end of the table 10 and move toward the other end carried by the rotation of the rollers which all move in either a clockwise or counterclockwise direction. In FIG. 4 the rollers are illustrated as moving in a clockwise direction of rotation.

French fries that are deposited so as to be essentially parallel to the direction of movement (and perpendicular to the roller shafts) are illustrated in FIG. 4 as french fries 34*a*, 34*b* and 34*c*. These french fries are carried along by the rollers so as to bridge the gaps 18 between adjacent rollers. This is caused by the camming action of the rollers 12. Some potatoes, however, are deposited on the table so as to be oriented parallel or substantially parallel to the shafts 14 of the rollers 12 such as potatoes 36*a*, 36*b* and 36*c*. Other potato pieces are not cut to the proper one quarter inch dimension and are slivers such as slivers 38. Still other pieces will be smaller than even slivers 38 and are referred to as fines (not shown).

Each of the rollers 12 have a peripheral surface that consists of alternating crown portions 40 and flat portions 42. The rollers 12 are oriented so that as they rotate, the crown portions 40 of one roller alternate with the flat portions 42 of another across the gaps 18. Once this orientation has been established, the rotation of the rollers is timed to maintain this phase alignment between adjacent rollers across the gaps. If at one instant in time a particular roller has its crown portions 40 extending into the gaps 18 on either side, the two adjacent rollers will have their respective flat portions 42 opposite the first roller's crown portions 40 across the gaps on either side. This is best illustrated by the second, third and fourth rollers in FIG. 4. It will be appreciated that at any given time, half of the rollers will have their crown portions oriented in the gaps and the other half which are spaced alternately with respect to the first half will have flat portions oriented towards the gaps. Proper phasing between adjacent rollers is maintained by the drive chain 30 in conjunction with uniform spacing between adjacent rollers. Once the proper rotational orientation is set up, the chain and sprocket arrangement driving the rollers will ensure that the rollers rotate in the proper phase.

It is this phase relationship between adjacent rollers that permits undersized slivers such as the slivers 38 to fall through the roller bed 10 and prevents properly sized product such as french fries 36*a*, 36*b* and 36*c* from falling through. In the case of product such as french fry 36*a* there is an initial tendency for the product to attempt to fall between two rollers. However, the gap 18 is spaced too narrowly to allow this. When the french fry 36*a* falls into the gap it stays there until a flat portion 42 of the next adjacent roller rotates up out of the gap to capture it. Capture is achieved by surface tension that causes the wet french fry illustrated by french fry 36*b* to stick to the flat 42. As the flat rotates even further the french fry is lifted out of the gap as illustrated by french fry 36*c* and resumes the proper direction of travel. The gaps are sized, however, to permit thin slivers such as slivers 38 to fall through the gaps and thereby become separated from the properly sized product.

It frequently happens that some food product is cut unevenly resulting in a properly sized portion and a sliver-like portion. FIG. 4*a* illustrates how the apparatus deals with this type of product. The gap width 18 permits the sliver portion to become lodged between two adjacent rollers while the properly sized portion is too big to pass through. As a crown portion 40 of a roller 12 rotates upwards into the gap it physically breaks the sliver portion off of the correctly sized portion. Surface tension will then carry the properly sized portion away while permitting the sliver to fall through.

The speed of the rollers 12 determines in part the size of the slivers or fines that will be allowed to drop through the roller bed. If the rollers turn too fast very little may drop through. It has been found that the optimum roller speed lies between 125 and 300 RPM. Also important is the spacing or gap width 18 between adjacent rollers. This dimension is defined as the spacing between adjacent rollers that are properly phased with the crown 40 of one roller directly opposite the flat 42 of an adjacent roller. For ¼" french fries the optimum spacing for removal of slivers is 0.125" or half the cross section of the desired product dimension. The removal of fines requires a different spacing, and in the case of ¼" french fries, the minimum practical spacing for fines is 0.010". This traps some larger fines between the rollers but they are usually pulled through and fall off due to centrifugal force and gravity.

The drive mechanism illustrated shows a chain and sprocket drive system which also functions to time the rollers 12 so that correct phasing is maintained between adjacent rollers. Other drive systems could be used, however, such as belt drives or gear arrangements. Also the adjustment of the roller spacing could be accomplished in many different ways. Instead of a track, the roller shafts could be placed in multiple detent holders having predetermined spacings between them. The motor that is used as the principal drive for the rollers should be a variable speed motor or should include gears for speed variability because speed of the rollers influences the degree to which different sizes of fines or slivers are eliminated from the product.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. Apparatus for separating fines and slivers from sliced food product comprising:

(a) a roller table having a frame and including a plurality of elongate rollers extending from one side of the frame to the other and aligned side-by-side on respective parallel roller shafts, each roller having an outer surface shaped to provide rounded crown portions alternating with flat portions about its periphery;

(b) drive means for causing rotation of the rollers in the same direction of rotation so as to cause movement of the sliced food product from one end of the roller table to the other; and (c) wherein said rollers are spaced apart to provide gaps between adjacent rollers and are rotationally oriented relative to each other such that the crown portions and flat portions of respective adjacent rollers coincide alternately in said gaps as said rollers rotate.

2. The apparatus of claim 1 wherein said drive means includes means for varying the rotational speed of the rollers.

3. The apparatus of claim 1, further including means for adjusting the width of the gaps between adjacent rollers.

4. The rotary feed table of claim 3 wherein the width of the gaps is adjusted such that the width does not exceed one-half of a selected cross-sectional dimension of the food product.

5. The apparatus of claim 1 wherein said drive means comprises a motor having an output shaft coupled to said rollers by chain and sprocket means for driving the rollers in unison.

6. The apparatus of claim 1, including timing means for phasing the rotation of adjacent rollers so that the crown portion of a first roller is present in the gap coincident with the flat portion of an adjacent roller.

7. The apparatus of claim 6 wherein all rollers are spaced uniformly apart.

8. A rotary feed table for separating fines and slivers from sliced food product comprising:

(a) a substantially horizontal roller bed including a plurality of parallel rollers separated by gaps of a predetermined spacing;

(b) drive means for rotating the rollers;

(c) each of said rollers including an outer periphery shaped to provide rounded crown portions alternating with flat portions thereon; and (d) wherein the rollers are rotationally oriented relative to each other such that the crown portions and flat portions of respective adjacent rollers coincide alternately in said gaps as the rollers rotate.

9. The rotary feed table of claim 8 wherein the phasing means comprises a chain coupled to sprockets on the respective ends of each of the rollers.

10. The rotary feed table of claim 8 wherein the rollers are spaced uniformly apart to provide a constant gap width between adjacent rollers.

11. The rotary feed table of claim 8 wherein the drive means rotates all of the rollers in the same rotational direction so as to advance the food product across the roller bed.

12. The rotary feed table of claim 11 wherein the speed of the drive means is variable.

13. The rotary feed table of claim 8 wherein the predetermined spacing of the gaps between adjacent rollers is adjustable.

14. The rotary feed table of claim 8 wherein the sliced food product has a nominal cross-sectional dimension and wherein the predetermined spacing of the gaps is no greater than one-half the nominal cross-sectional dimension of the food product.

15. The rotary feed table of claim 8 wherein there are six crown portions and six flat portions on each roller.

* * * * *